US009066839B2

(12) United States Patent
Al-Madi et al.

(10) Patent No.: US 9,066,839 B2
(45) Date of Patent: Jun. 30, 2015

(54) MOVING BATH TUB AND A LIFT FOR BATHING ICU PATIENTS

(75) Inventors: Mohammed Abdulrahman Hamad Al-Madi, Riyadh (SA); Sager Ibrahim Mohammed Aref, Riyadh (SA)

(73) Assignee: King Saud University, Riyadh (SA)

( * ) Notice: Subject to any disclaimer, the term of this patent is extended or adjusted under 35 U.S.C. 154(b) by 152 days.

(21) Appl. No.: 13/698,425

(22) PCT Filed: Apr. 14, 2011

(86) PCT No.: PCT/EP2011/001892

§ 371 (c)(1),
(2), (4) Date: Nov. 19, 2012

(87) PCT Pub. No.: WO2011/144281

PCT Pub. Date: Nov. 24, 2011

(65) Prior Publication Data

US 2013/0061385 A1 Mar. 14, 2013

(30) Foreign Application Priority Data

May 17, 2010 (SA) ..... 110310391

(51) Int. Cl.

| | |
|---|---|
| ***A47K 3/00*** | (2006.01) |
| ***A61G 7/00*** | (2006.01) |
| ***A61G 7/10*** | (2006.01) |
| *A61G 7/057* | (2006.01) |

(52) U.S. Cl.

CPC ..... *A61G 7/0005* (2013.01); *A61G 7/057* (2013.01); *A61G 7/1003* (2013.01); *A61G 7/1015* (2013.01); *A61G 7/1019* (2013.01); *A61G 7/1051* (2013.01); *A61G 2203/80* (2013.01)

(58) Field of Classification Search

CPC . A61G 7/0005; A61G 7/0533; A61G 7/1003; A61G 7/1015; A61G 7/1019; A61G 7/1074; A47K 3/06

USPC ..... 4/547, 564.1, 554, 584, 594, 592; 5/85.1, 86.1, 900

See application file for complete search history.

(56) References Cited

U.S. PATENT DOCUMENTS 775,520 A 11/1904 Crigler
2,541,263 A * 2/1951 Mayo et al. ..... 4/540

(Continued)

FOREIGN PATENT DOCUMENTS

WO 01/70161 A1 9/2001

OTHER PUBLICATIONS

PCT/EP2011/001892; PCT International Search Report and Written Opinion of the International Searching Authority dated Jul. 14, 2011.

*Primary Examiner* — Paul R Durand
*Assistant Examiner* — Nicholas Ros
(74) *Attorney, Agent, or Firm* — Renner, Otto, Boisselle & Sklar, LLP

(57) ABSTRACT

The invention consists of two parts. The first part is a lift made of four columns placed at the corners of the patient's bed. Connected to the columns, a bed made of a net of intersecting threads placed between the patient and the bed and are used to carry the patient in the sleeping position over the bed. The second part is a bath tub and a moving cleaning system on suitable moving equipments that can be easily moved to be inserted above the patients bed or below the patient via the aforementioned net. The patient is brought down to be cleaned in the bath tub using the crane.

5 Claims, 6 Drawing Sheets

(56) References Cited

U.S. PATENT DOCUMENTS

| | | | | | |
|---|---|---|---|---|---|
| 3,701,170 | A * | 10/1972 | Bond | 4/597 |
| 4,207,629 | A * | 6/1980 | Kagawa | 4/540 |
| 4,982,462 | A | 1/1991 | Wada | |
| 5,235,712 | A * | 8/1993 | Smith | 5/84.1 |
| 5,544,371 | A * | 8/1996 | Fuller | 5/85.1 |
| 6,735,794 | B1 | 5/2004 | Way et al. | |

* cited by examiner

MOVING BATH TUB AND A LIFT FOR BATHING ICU PATIENTS

INVENTION BACKGROUND

This invention is concerned with a bath tub for bathing Intensive Care Unit (ICU) hospital patients.

GENERAL DESCRIPTION

ICU nurses find great difficulty in bathing patients, especially those who are difficult to move around while staying in bed without movement or regular cleaning will cause them to develop ulcers and other skin diseases. This applies generally to those who are in long-term comas or connected to machines that require them to stay connected to them permanently.

The closest technology to the present invention is the crane that is placed above the beds of patients such that the patient is carried in the sitting position from the bed to the wheelchair to take them to the W.C. (Water Closet) and clean them. This application is considered fit in cases in which there's no alternative that allows for carrying the patient in the sitting position rather than the sleeping position. This application requires taking the patient to the W.C. and disconnecting him/her from the machines or moving the machines, while in the present invention, the bath tub is brought to the patient's location without them exiting the room or disconnecting them from the machines.

The invention consists of two parts. The first part is a lift made of four columns placed at the corners of the patient's bed. Connected to the columns, a bed made of a net of intersecting threads between the patient and the bed and are used to lift the patient in the sleeping position above the bed. The second part is a bath tub and a moving cleaning system on suitable moving equipments that can be easily moved to be inserted above the patients bed or below the patient via the aforementioned web. The patient is brought down to be cleaned in the bath tub using the crane.

DETAILED DESCRIPTION

Figure 1:
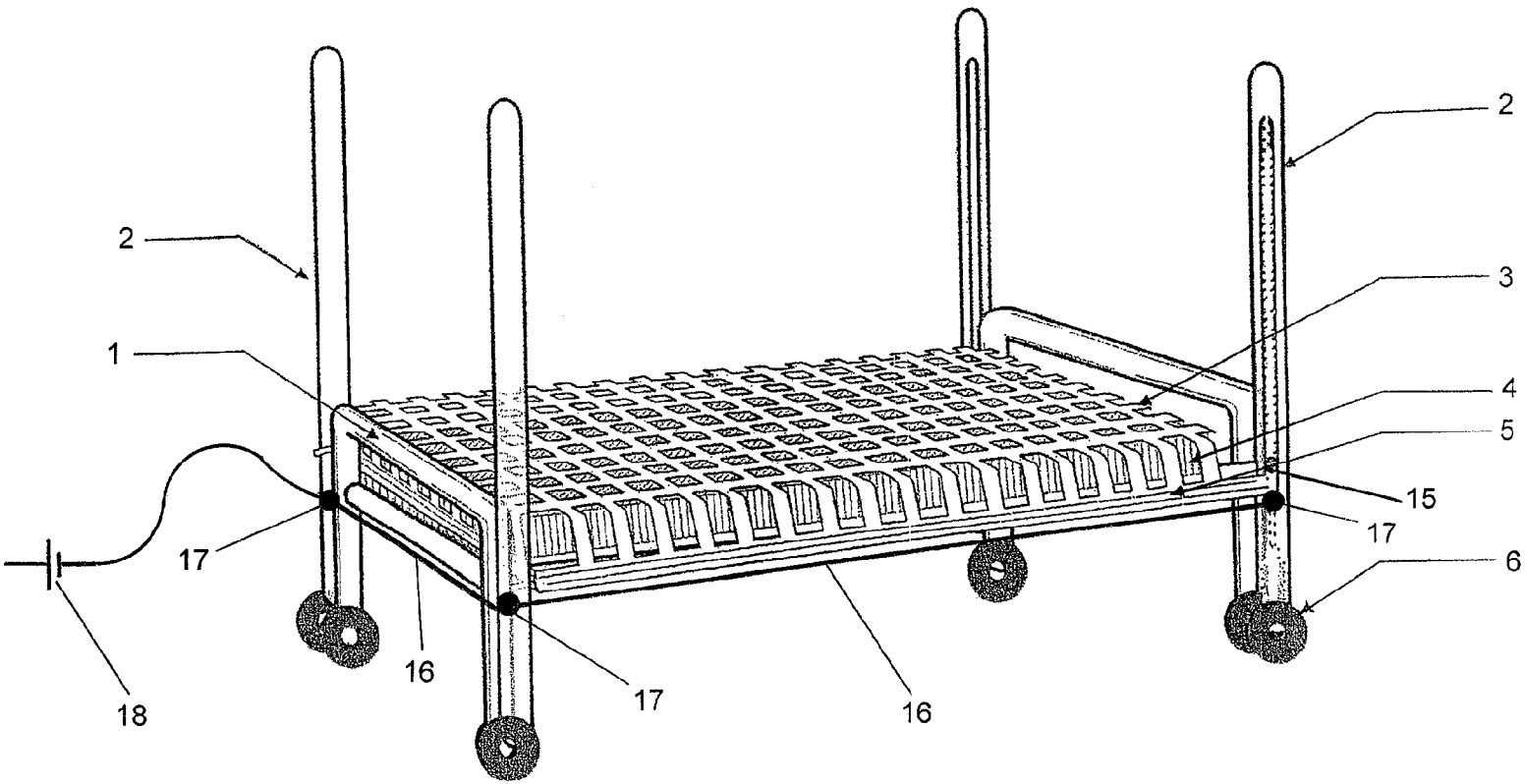
FIG. 1 shows the bed with the four columns connected to it and the net connected to the aforementioned columns.

FIG. 1 shows the patient's bed 1 attached to it the lifting columns 2 that work on lifting the patients carrier net 3, wherein the net is attached 3 from its four corners to the lifting columns 2 and is made from intersecting resilient textile with wide threads so that the patient is not injured when he is being carried. Net 3 is placed directly over the mattress 4 and directly below the patient's body to allow for the patient to be lifted without requiring the removal of the bed 1 sheets when he/she is lifted. The lifting columns 2 are connected to the bed via mechanical joints 15 suitable for this application to guarantee that each one is straight and are not tilted when the patient is being lifted upwards. The length of the columns are enough to carry the patient's body to a level enough to be placed inside the tub 8 (FIG. 4)) below the patient's body which is carried on the net 3. We may attach to the bottom end of each column of the lifting columns 2 wheels 6 for easily moving them each separately rather than carrying them.

Figure 2:
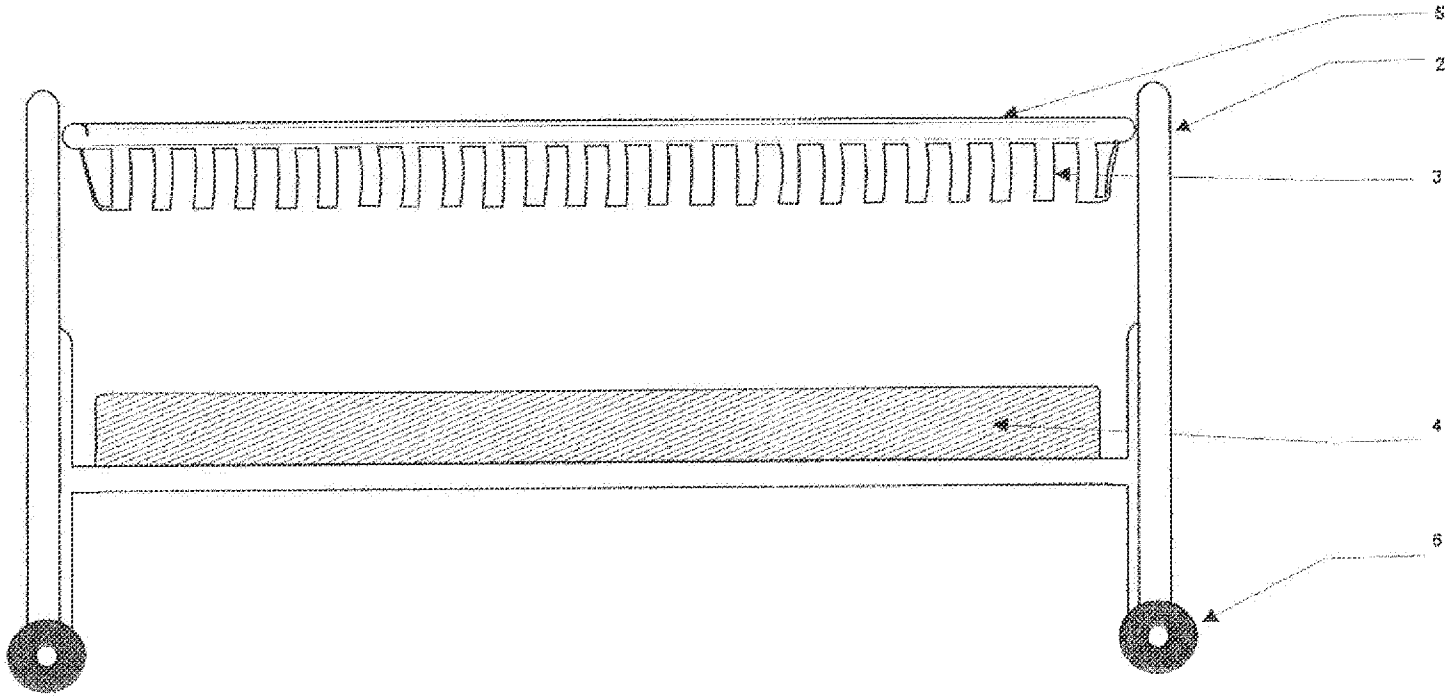
FIG. 2 shows a side view of the bed and the columns connected to it after the patient carrying net is brought up.

FIG. 2 shows a side view of the bed 1 after the net 3 is raised to the highest level above the bed 1 using the lifting columns 2. The lifting net 3 may have supports 5 around it and connected with the lifting columns 2 to reinforce the net 3 when it is lifted. The supports 5 may be metallic or any plastic material or else to perform the task. The net may not have supports 5 around it or the supports 5 may be of the same material as the net's (5) tissue.

Figure 3:
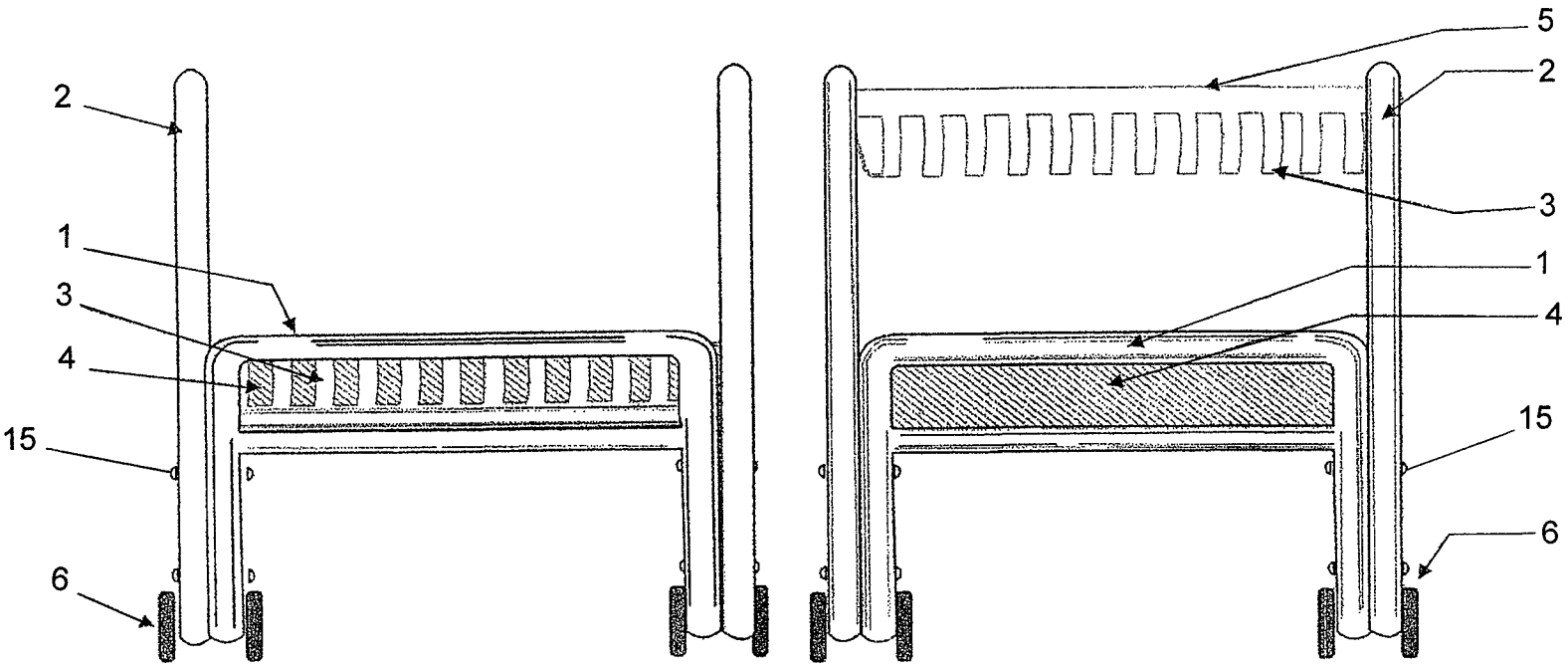
FIG. 3 shows a front view or rear view of the bed and the columns are connected to it in the elevated and default position of the patient's net.

FIG. 3 shows a front or rear view of the bed 1 in the raised and lowered net positions on bed 1.

The lifting columns 2 may raise the net 3 either manually or automatically. It's preferred to be automatic so that the four corners for the net 3 are lifted at the same time and in this case, the four columns 2 are connected to electrical wires 16 each of which is connected to a plug 17 in each of the columns 2. Each column 2 contains a lift motor 19 that lifts the net that is attached to the four columns 2 at the same time; this detail is not shown in the figures. One of the aforementioned columns 2 is connected to a power source 18 that supplies it and the three other columns with electrical power.

Figure 4:
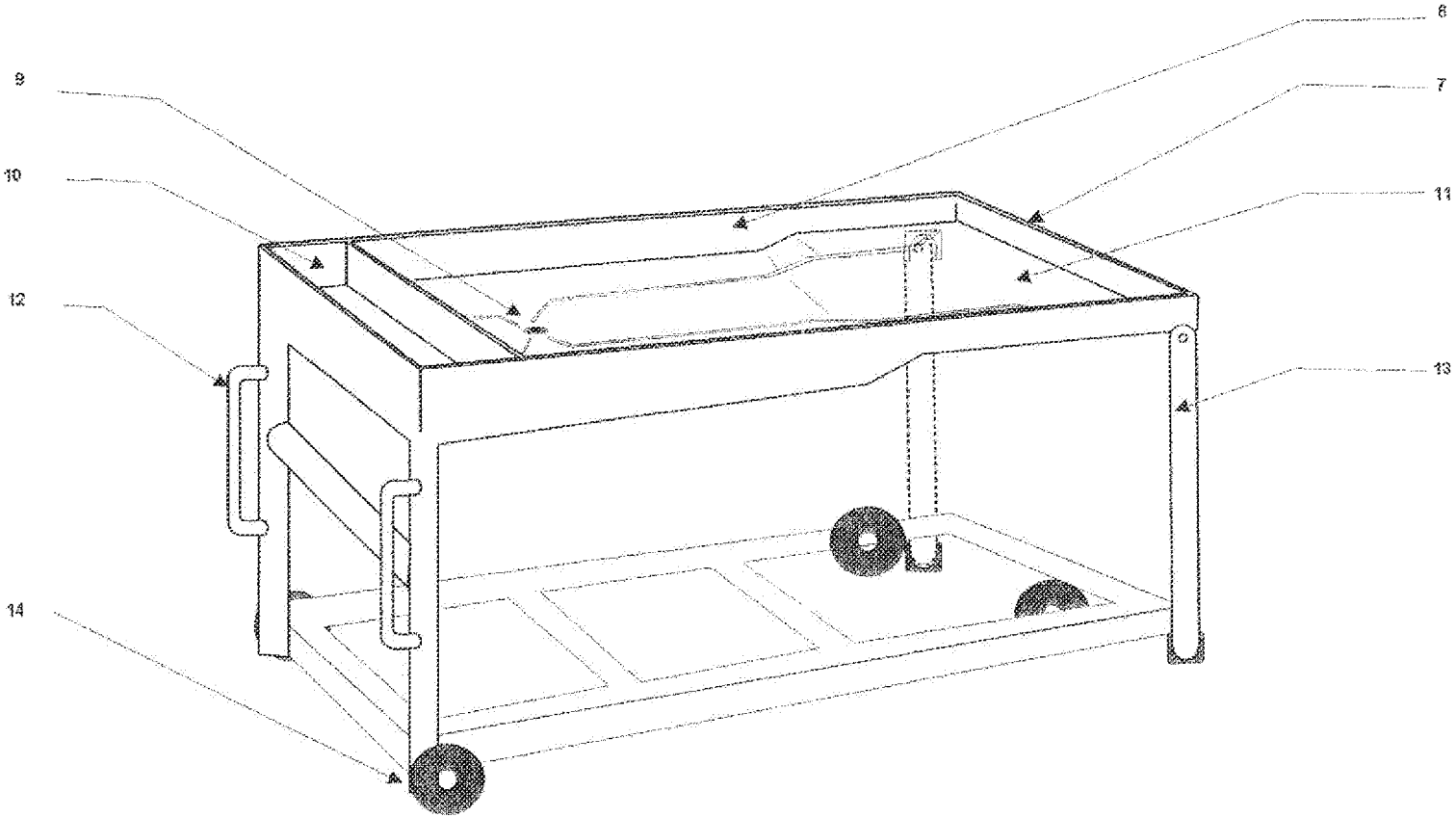
FIG. 4 shows the moving bath tub of the patient.
Figure 5:
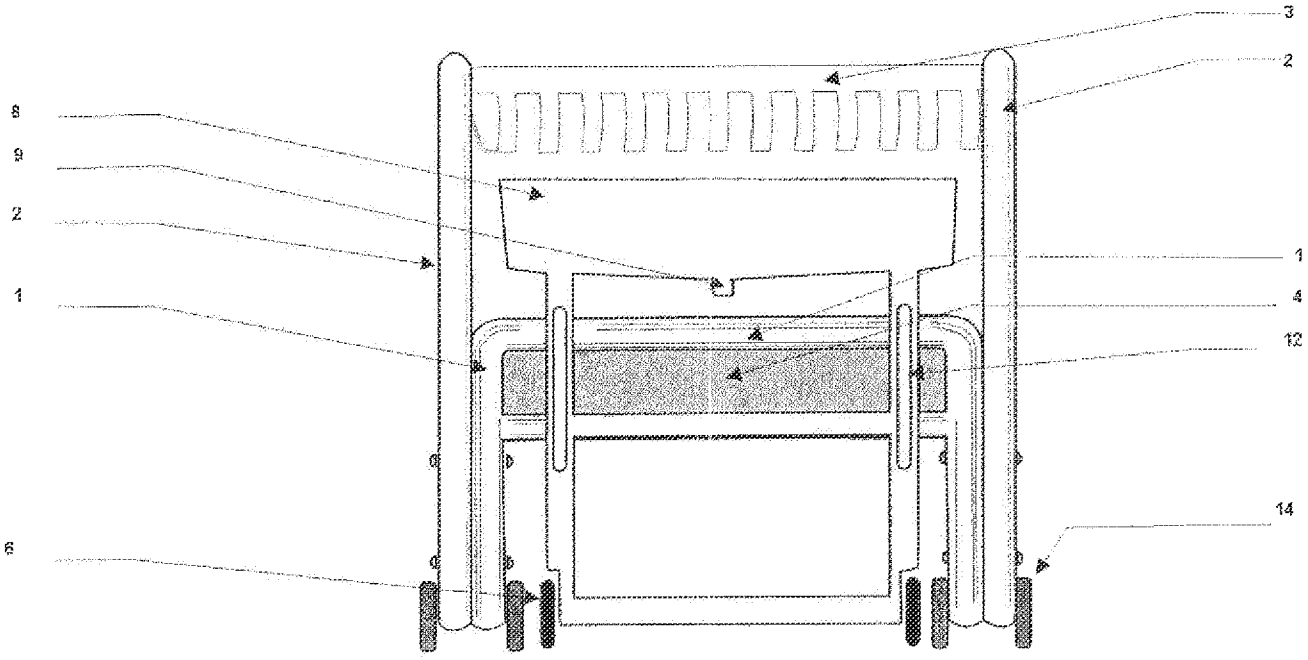
FIG. 5 shows a front or rear view with the net lifted upward and bath tub being inserted above the bed and below the net.

After the patient is lifted by using the net 3, the tub 8 is placed from the side of the patients feet of the bed 1 below the patient who is lifted on the net 3 and above the bed as in FIG. 5, the bath tub 8 consists of—as shown in FIG. 4—the bathing spot 11 which is lofty from the front side 7 and drafted towards the drainage pipe 9 close to the solutions and cleaning products box 10. This is to make easy draining the water. The tub is moved 8 with wheels 14 for easy mobility and it may be supplied with handles for easy control of direction. Since the weight of the patient and the water act on the tub 8, it is provided with, from the front end 7 with legs 13 that are foldable as in FIG. 6 to place the tub above the bed 1 then they can be drawn to the ground to support the tub 8 while bathing the patient.

Figure 6:
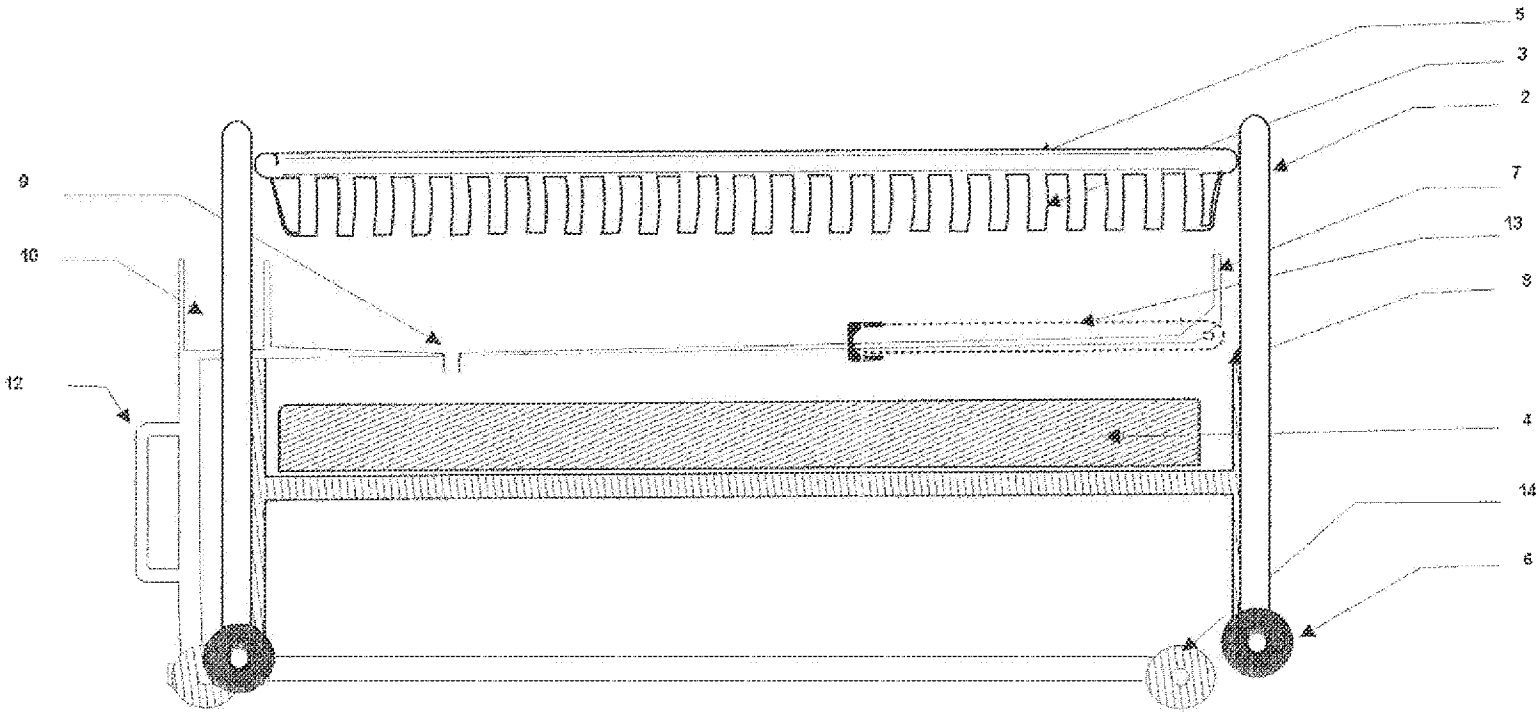
FIG. 6 shows the a side view of the bed with the net lifted upward and the bath tub being inserted above the patient's bed and below the net.

The tub 8 is supplied with water needed for bathing by water outlets attached to the wall near the patient's bed 1 using proper connections (water hose) that end with water outlets such as a shower. The pressure of water may be controlled as desired. It is also possible to connect drying air from the special outlets fixated to the wall near the patient's bed 1. A container 10 for solutions and cleansers. FIG. 6 shows a side view of the position of the bath tub 8 when it's above the bed 1. It is known that the bath tub may be made of any metallic materials (stainless steel for example) or plastic materials or a composite material suitable for this application.

The invention claimed is:

1. A mobile bath tub, comprising two parts:

First Part, comprising: a lift of four lifting columns each are connected to a corner of a bed by jointing methods, a patient carrying net having four corners, each corner connected to one of the lifting columns, wherein the columns are wired to each other using electrical wires and plugs, wherein one of the columns is connected to a power source that supplies it and the three other columns with electrical power, wherein each column further comprises an electric motor to lift the net and wherein the electrical wires can be unplugged for easy moving of each column separately; and Second Part comprising: a mobile bath tub on wheels, wherein the wheels are disposed on a lower structure under the bed and the mobile bath tub is disposed parallel to the lower structure and above the bed from the front and rear ends of the bed, wherein the tub is attached to the lower structure from a short side and an other side remains suspended in the air to allow for placing the bath tub above the bed, wherein the bath tub and the lower structure parallel to it are smaller in width than the width of the patient's bed, as width is defined as the side in which the head or feet of the patient is/are placed; and wherein the bath tub can be placed above the bed and between the lifting columns.

2. A mobile bath tub as in claim 1 wherein each column of the lifting columns comprises a wheel and the lifting columns are movable on the wheels.

3. A mobile bath tub as in claim 1 wherein the carrying net is made of resilient textile and is made in the shape of a net comprising a plurality of wide intersecting threads.

4. A mobile bath tub as in claim 1 wherein the bath tub contains a water drainage outlet to drain water used to bathe a patient.

5. A mobile bath tub as in claim 1 wherein the bath tub is provided with foldable legs fixed to the suspended side of the bath tub in the lower structure for easy moving of the of the bath tub.

* * * * *